US007594483B2

(12) United States Patent
Tsuji et al.

(10) Patent No.: US 7,594,483 B2
(45) Date of Patent: Sep. 29, 2009

(54) INTERNAL COMBUSTION ENGINE COOLING SYSTEM

(75) Inventors: Naohide Tsuji, Hiratsuka (JP); Eiji Aiyoshizawa, Yokohama (JP); Nobuhiro Abe, Atsugi (JP); Tatsuo Kuraishi, Ebina (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 12/110,672

(22) Filed: Apr. 28, 2008

(65) Prior Publication Data

US 2008/0276886 A1 Nov. 13, 2008

(30) Foreign Application Priority Data

May 7, 2007 (JP) ..... 2007-122194

(51) Int. Cl.
*F01P 7/16* (2006.01)
*F01P 11/08* (2006.01)
*F01P 3/12* (2006.01)

(52) U.S. Cl. ..... 123/41.1; 165/43; 165/51; 165/52

(58) Field of Classification Search ..... 123/41.1, 123/41.31, 41.33, 41.44, 41.48, 41.5, 41.29, 123/41.08, 41.09, 568.12, 568.17, 568.18; 165/43, 51, 52
See application file for complete search history.

(56) References Cited

U.S. PATENT DOCUMENTS 5,537,956 A * 7/1996 Rennfeld et al. ..... 123/41.29
5,730,089 A * 3/1998 Morikawa et al. ..... 123/41.14
5,894,834 A * 4/1999 Kim ..... 123/552
6,213,233 B1 * 4/2001 Sonntag et al. ..... 180/65.245
6,340,006 B1 * 1/2002 Malatto et al. ..... 123/41.29
6,595,164 B2 * 7/2003 Kunze et al. ..... 123/41.1
6,601,545 B1 * 8/2003 Hohl ..... 123/41.31
6,668,764 B1 * 12/2003 Henderson et al. ..... 123/41.29
6,772,715 B2 * 8/2004 Pfeffinger et al. ..... 123/41.31
6,899,162 B2 * 5/2005 Hohl et al. ..... 165/41
7,047,913 B2 * 5/2006 Werner et al. ..... 123/41.33
7,069,880 B2 * 7/2006 Hutchins ..... 123/41.29
2003/0019442 A1 * 1/2003 Yoshikawa et al. ..... 123/41.1
2003/0056737 A1 * 3/2003 Hyde ..... 123/41.1
2003/0070427 A1 * 4/2003 Banzhaf et al. ..... 60/320

(Continued)

FOREIGN PATENT DOCUMENTS

JP 2004-332583 A 11/2004

*Primary Examiner*—Michael Cuff
*Assistant Examiner*—Hung Q Nguyen
(74) *Attorney, Agent, or Firm*—Global IP Counselors, LLP

(57) ABSTRACT

An engine cooling system has an engine water jacket, a coolant circulation passage connecting a water jacket outlet to a water jacket inlet and a radiator disposed in the coolant circulation passage. A thermostat valve selectively closes and opens the coolant circulation passage leading to the radiator. A bypass passage extends from between the water jacket outlet and the thermostat valve to an outlet side of the radiator. A bridge passage connects a portion of the bypass passage to a portion of the coolant circulation passage located downstream of the radiator and upstream of where the bypass passage merges therewith. A resistance generating section is located downstream of the bridge passage connection to the coolant circulation passage and upstream of the bypass passage connection to the coolant circulation passage. The bridge passage has an oil heat exchanger to exchange heat between the cooling medium and transmission oil passing therethrough.

10 Claims, 4 Drawing Sheets

U.S. PATENT DOCUMENTS

2003/0127528 A1* 7/2003 Sabhapathy et al. ..... 237/12.3 B
2006/0081355 A1* 4/2006 Horstmann et al. ..... 165/43
2006/0231047 A1* 10/2006 Hiroshima ..... 123/41.29

* cited by examiner

INTERNAL COMBUSTION ENGINE COOLING SYSTEM

CROSS-REFERENCE TO RELATED APPLICATIONS

This application claims priority to Japanese Patent Application No. 2007-122194, filed on May 7, 2007. The entire disclosure of Japanese Patent Application No. 2007-122194 is hereby incorporated herein by reference.

BACKGROUND OF THE INVENTION

1. Field of the Invention

The present invention generally relates to an internal combustion engine cooling system. More specifically, the present invention relates to an internal combustion engine cooling system that regulates a temperature of transmission oil using a coolant (cooling medium) that also serves to cool the internal combustion engine.

2. Background Information

A technology has been proposed for regulating a temperature of transmission oil by heating and cooling the transmission oil using a coolant from an internal combustion engine (see Japanese Laid-Open Patent Publication No. 2004-332583). In this proposed technology, a water-cooled engine cooling system apparatus uses the engine coolant in a single oil heat exchanger to heat and cool the transmission oil in an efficient manner. A thermostat valve is provided between an outlet of a radiator and a water pump. The oil heat exchanger exchanges heat between the coolant and the transmission oil, with a coolant inflow passage carrying the coolant from an outlet side of a water pump to the oil heat exchanger. A first coolant outflow passage returns the coolant exiting the oil heat exchanger back to a position between the radiator and the thermostat valve, and a second coolant outflow passage returns the coolant exiting the oil heat exchanger to a position between the thermostat valve and the water pump. The cooling system executes an inlet coolant temperature control to regulate the temperature transmission oil temperature.

In view of the above, it will be apparent to those skilled in the art from this disclosure that there exists a need for an improved internal combustion engine cooling system. This invention addresses this need in the art as well as other needs, which will become apparent to those skilled in the art from this disclosure.

SUMMARY OF THE INVENTION

With the technology presented in Japanese Laid-Open Patent Publication No. 2004-332583, a thermostat and a bypass passage are provided to return coolant that has circulated through the water jacket to an upstream portion of coolant passage leading from the radiator to the oil heat exchanger. With such a configuration, the coolant flowing to the oil heat exchanger is comparatively warm. Consequently, the temperature of the transmission oil will become high when the load imposed on the engine is high and when it is necessary to aggressively cool the transmission oil with the oil heat exchanger.

The present invention was conceived in view of this problem. One object is to provide an internal combustion engine cooling system that can prevent the temperature of the transmission oil from becoming excessively high.

In view of the above, an internal combustion engine cooling system is provided that basically comprises an engine water jacket, a coolant circulation passage, a radiator, a thermostat valve, a bypass passage, a bridge passage, a circulation passage resistance generating section and an oil heat exchanger. The coolant circulation passage fluidly connects a water jacket outlet of the engine water jacket to a water jacket inlet of the engine water jacket. The radiator is disposed in the coolant circulation passage between the water jacket outlet and the water jacket inlet. The thermostat valve is disposed in the coolant circulation passage between an inlet side of the radiator and the water jacket outlet to close the coolant circulation passage leading to the radiator when a coolant temperature of the cooling medium is lower than a prescribed temperature and to open the coolant circulation passage leading to the radiator when the coolant temperature of the cooling medium is equal to or higher than a prescribed temperature. The bypass passage branches from the coolant circulation passage at a position located between the water jacket outlet and the thermostat valve, and connects to the coolant circulation passage on an outlet side of the radiator for bypassing the thermostat valve and the radiator. The bridge passage connects an intermediate portion of the bypass passage to an intermediate portion of the coolant circulation passage located downstream of the radiator and upstream of a merging position where the bypass passage merges with the coolant circulation passage for establishing communication between the intermediate portions of the bypass passage and the coolant circulation passage. The circulation passage resistance generating section is arranged in a portion of the coolant circulation passage located downstream of a position where the bridge passage connects to the coolant circulation passage and upstream of the merging position where the bypass passage merges with the coolant circulation passage. The oil heat exchanger is arranged in the bridge passage to exchange heat between the cooling medium and transmission oil passing therethrough.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Selected embodiments of the present invention will now be explained with reference to the drawings. It will be apparent to those skilled in the art from this disclosure that the following descriptions of the embodiments of the present invention are provided for illustration only and not for the purpose of limiting the invention as defined by the appended claims and their equivalents.

Figure 1:
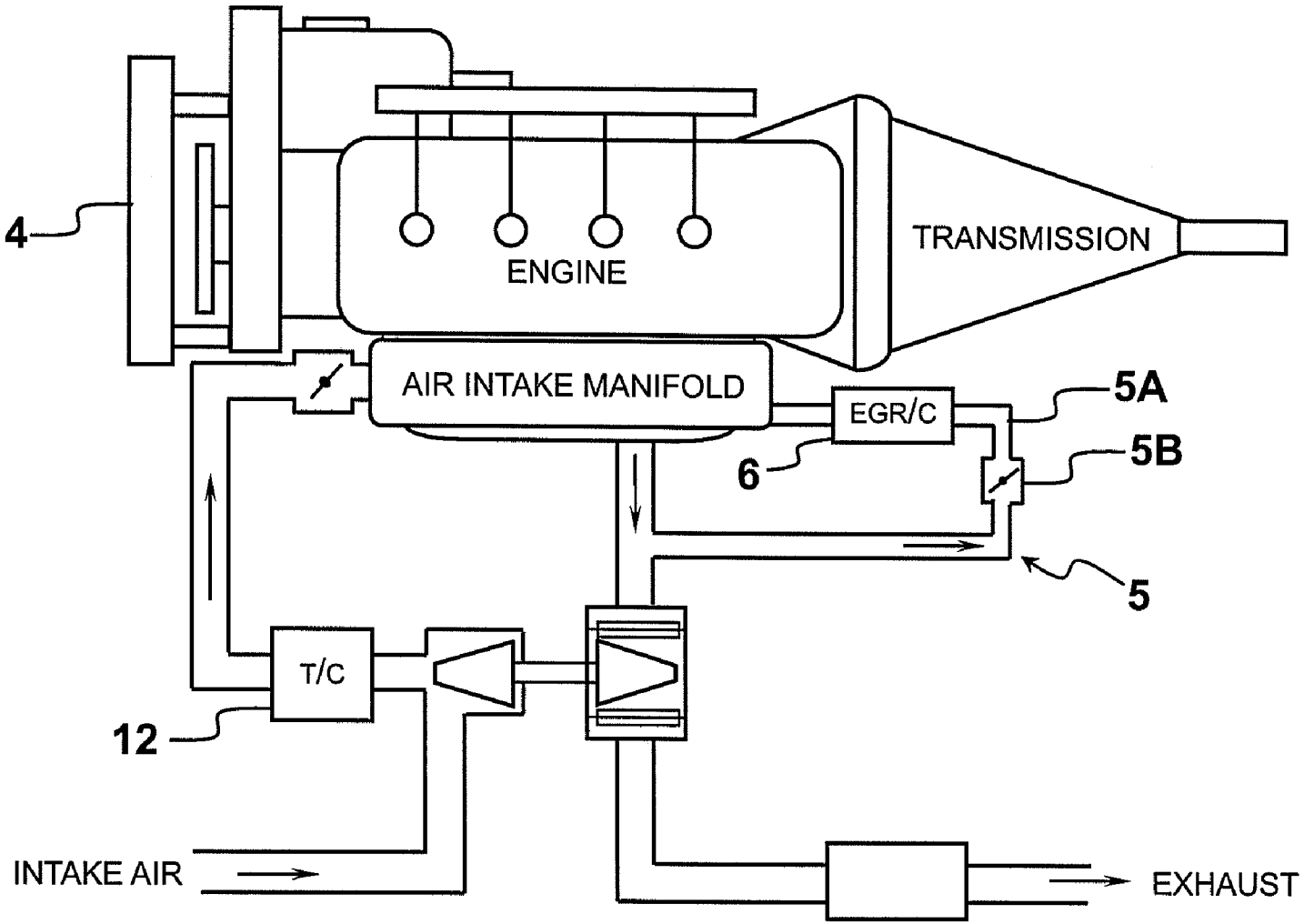
FIG. 1 is a simplified block diagram of an internal combustion engine (e.g., a diesel engine) in which an internal combustion engine cooling system is employed in accordance with one embodiment.
Figure 2:
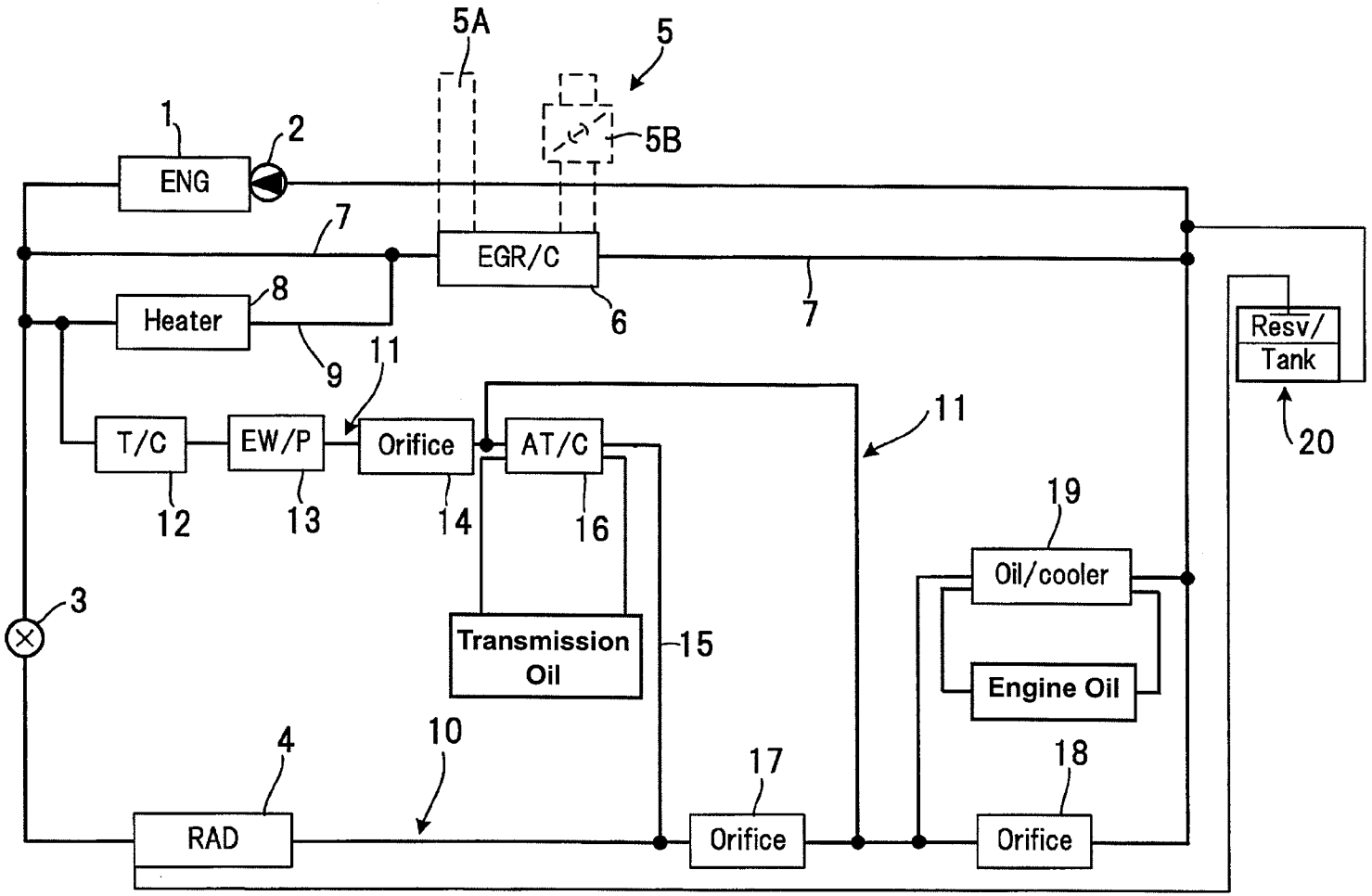
FIG. 2 is a simplified block diagram of the internal combustion engine cooling system in accordance with the illustrated embodiment for the internal combustion engine illustrated in FIG. 1.

Referring initially to FIG. 1, a schematic diagram of a direct injection diesel engine is illustrated in which an internal combustion engine cooling system is employed illustrated in accordance with one embodiment. In particular, FIG. 2 diagrammatically illustrates the internal combustion engine cooling system of the illustrated embodiment. The diesel engines are well known in the art. Since diesel engines are well known in the art, the precise structure of the diesel engine will not be discussed or illustrated in detail herein.

The cooling system is a water-cooled internal combustion engine cooling system in which an outlet coolant temperature control is performed. The constituent features will now be explained. An engine water jacket 1 is provided on an engine with a water pump 2 fluidly connected to the water jacket 1 for pumping coolant into the water jacket 1. The water pump 2 is arranged upstream of the water jacket 1. A thermostat valve 3 is arranged downstream of the water jacket 1 such that coolant exiting the water jacket 1 flows through the thermostat valve 3. A radiator 4 is arranged downstream of the thermostat valve 3 for receiving coolant from the water jacket 1. Coolant that has been cooled in the radiator 4 is returned to the water pump 2 as a cooled cooling medium.

Also an exhaust gas recirculation (EGR) apparatus 5 is provided that includes an exhaust gas recirculation (EGR) passage 5A, an exhaust gas recirculation (EGR) valve 5B arranged in the EGR passage 5A, and an exhaust gas recirculation cooling device 6 (hereinafter called "EGR cooler") provided in the EGR passage 5A to exchange heat between an exhaust gas flowing through the EGR passage 5A and the coolant. An exhaust gas recirculation cooling device circulation passage 7 (hereinafter called "EGR cooler circulation passage") is provided to pass coolant through the EGR cooler 6. In particular, a portion of the coolant discharged from the water jacket 1 passes through the EGR cooler 6 and a portion passes through a heater core 8 arranged in a heater passage 9 for heating the interior of the vehicle.

The cooling system includes an engine coolant circulation passage 10 that carries coolant exiting the engine (water jacket 1) through the radiator 4 and back to the engine (water jacket 1). The thermostat valve 3 and the radiator 4 are provided in the engine coolant circulation passage 10. The water pump 2 is driven by a crankshaft (not shown) of the engine. The thermostat valve 3 shuts off the flow of coolant to the radiator 4 when the temperature of the coolant coming from the water jacket 1 is lower than a prescribed temperature and allows (opens) the flow of coolant to the radiator 4 when the temperature of the coolant is equal to or higher than the prescribed temperature. The prescribed temperature is set in advance to a temperature (e.g., 90° C.) lower than a minimum temperature at which there is a possibility that the engine will overheat (temperature will be come excessive) such that the passage leading to the radiator 4 is opened when the coolant temperature is below the minimum temperature.

The coolant passages leading to the EGR cooler 6 and the heater core 8 are arranged to branch from a portion of the coolant circulation passage 10 located between the water jacket 1 and the thermostat valve 3, pass through the EGR cooler 6 and/or the heater core 8, and return to the upstream side of the water pump 2 through the EGR cooler circulation passage 7.

A bypass passage 11 is also provided which branches from a portion of the coolant circulation passage 10 located between the water jacket 1 and the thermostat valve 3 and carries a portion of the coolant to a portion of the coolant circulation passage 10 located downstream of the radiator 4, thus bypassing the radiator 4.

The EGR passage 5A is a passage that directs a portion of the exhaust gas flowing through an exhaust passage of the engine to an air induction passage. The EGR cooler 6 exchanges heat between the coolant and the exhaust gas flowing through the EGR passage 5A so as to cool the exhaust gas introduced into the air induction passage. When the EGR valve 5B is opened, a portion of the engine exhaust gas flows through the EGR passage 5A and into the air induction passage. When the EGR valve 5B is closed, the EGR passage 5A is blocked such that engine exhaust gas does not flow therethrough. The EGR apparatus 5 serves to reduce the amount of NOx produced during fuel combustion by directing a portion of the exhaust gas into the intake air. When the amount of oxygen in the combustion chamber is insufficient or when the temperature inside the combustion chamber is too high, the EGR valve 5B is closed and exhaust gas recirculation is not executed.

The heater core 8 exchanges heat between air flowing through the heater passage 9 and coolant that is warmer than the air for heating the vehicle interior. The heated air exiting the heater core 8 is used to heat the vehicle interior or adjust a temperature of an air conditioner.

A turbo cooler 12, an electric water pump 13, and an orifice 14 are arranged along the bypass passage 11 in order as listed from upstream to downstream. The electric water pump 13 is driven by an electric motor to pump coolant through the bypass passage 11 in the downstream direction. The orifice 14 is provided to set the amount of coolant that will flow through the bypass passage 11. The orifice 14 constitutes a passage resistance generating section of the bypass passage 11. Of course, it will be apparent to those skilled in the art from this disclosure that other types of devices can be used for the passage resistance generating section such as a throttling device or a cooling device of an auxiliary machine provided on the internal combustion engine. In other words, the term "passage resistance generating section" refers to any device that can restrict the flow of the coolant or generate a resistance against the flow of the coolant.

A bridge passage 15 branches from a portion of the bypass passage 11 located downstream of the orifice 14. The bridge passage 15 branches from downstream of the orifice 14 and connects to the coolant circulation passage 10 downstream of the radiator 4, e.g., a passage in which coolant discharged from the radiator 4 flows. An oil heat exchanger or AT cooler 16 exchanges heat between the coolant and the transmission oil. The oil heat exchanger 16 is provided in the bridge passage 15. An orifice 17 is provided in the coolant circulation passage 10 at a position downstream of where the bridge passage connects to the coolant circulation passage 10. The orifice 17 constitutes a passage resistance generating section that serves to generate a resistance against flow through the passage 10. The orifice 17 is contrived to set the amount of coolant that will flow through the bridge passage 15, as will be explained later. Of course, it will be apparent to those skilled in the art from this disclosure that other types of devices can be used for the orifice 17 as needed and/or desired such as a throttling device or a cooling device of an auxiliary machine provided on the internal combustion engine.

When the engine is warming up and the thermostat valve 3 is closed, coolant that has passed through the bypass passage 11 flows into the bridge passage 15 and is discharged into the coolant circulation passage 10. When warming up has being completed and the thermostat valve 3 is open, coolant flows into the bridge passage 15 from the coolant circulation passage 10 and is discharged into the bypass passage 11.

As diagrammatically shown in FIG. 2, the oil heat exchanger (AT cooler) 16 is connected to an oil pipe such that the coolant can exchange heat with the transmission oil. The transmission oil flows from the transmission to the oil heat exchanger 16 and returns to the transmission after passing through the oil heat exchanger. With this arrangement, the transmission oil passing through the oil pipe and the coolant circulating through the bridge passage 15 exchange heat with each other such in the oil heat exchanger 16 that the transmission oil is heated or cooled.

The electric water pump 13 is provided when the internal combustion engine is a diesel engine. More specifically, a diesel engine is typically provided with a diesel particulate filter (DPF) for capturing particulate matter contained in the exhaust gas. When the amount of captured particulate matter exceeds a prescribed amount, the diesel particulate filter cannot capture any more particulate matter. Therefore, the diesel particulate filter is regenerated (i.e., the accumulated particulate matter is combusted) on a regular basis or when the amount of captured particulate matter has exceeded the prescribed amount. During regeneration, the internal combustion engine is stopped and, thus, the water pump 2 is not running. In order to prevent the intercooler and other items arranged in the bypass passage 11 from reaching excessively high temperatures, the electric water pump 13 is driven such that the amount of coolant necessary to cool the intercooler is sent through the bypass passage 11.

Another orifice 18 is arranged in the coolant circulation passage 10 at a position between the water pump 2 and the position where the bypass passage 11 merges with the coolant circulation passage 10. An oil cooler 19 is arranged in parallel with the orifice 18 to exchange heat between the coolant and an engine oil. Coolant vapor resulting from evaporation of the coolant inside the radiator 4 is guided to a reservoir tank 20 where it returns from the vapor state to a liquid state before being returned to the coolant circulation passage 10.

With this illustrated embodiment, when the engine is warming up and the thermostat valve 3 is closed, the cooling medium exits the outlet of the water jacket 1 and returns to the water jacket 1 through the bypass passage 11, thus accelerating the warming of the engine. A portion of the cooling medium flowing through the bypass passage 11 branches from the bypass passage 11 and enters the bridge passage 15, thus exchanging heat in the oil heat exchanger 16 before returning to the engine. The amount of cooling medium that enters the bridge passage 15 depends on the passage resistance generated by the orifice 17 (e.g., a passage resistance generating section) arranged in the coolant circulation passage downstream of the oil heat exchanger 16. Thus, while most of the cooling medium returns to the engine, an appropriate amount can be used to exchange heat in the oil heat exchanger 16. As a result, the cooling medium can be directed to the oil heat exchanger 16 even when the thermostat valve 3 is closed, thus enabling the oil temperature to be prevented from rising excessively when the engine operates under a very high load while cold.

Additionally, after the engine is warm and the thermostat valve 3 is opened, the cooling medium exiting the engine flows to the radiator 4 and a portion of the cooling medium cooled in the radiator 4 branches from the upstream side of the orifice 17 (e.g., a passage resistance generating section) and flows into the bridge passage 15 in the opposite direction as when the engine is warming, thus flowing directly to the oil heat exchanger 16 for the purpose of cooling the automatic transmission oil. As a result, when the thermostat valve 3 is opened, coolant flowing downstream of the radiator 4, which is the coolest coolant in the system, can be directed to the oil heat exchanger 16, thus enabling the oil temperature to be prevented from rising excessively when the engine operates under a very high load and enabling the size of the oil heat exchanger to be reduced.

Figure 3:
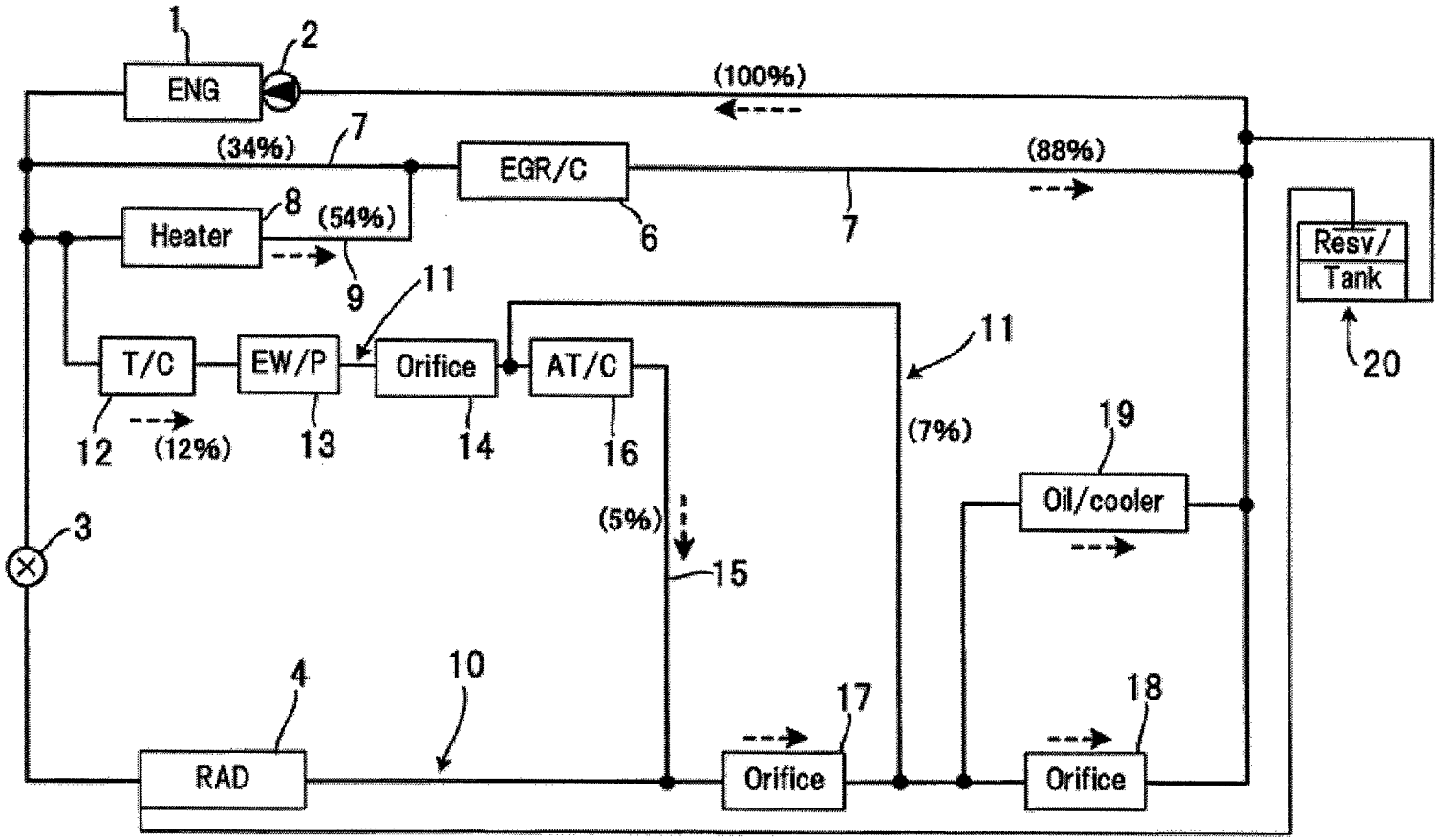
FIG. 3 is a block diagram of the internal combustion engine cooling system illustrated in FIG. 2, but indicating the coolant flow during engine warming.
Figure 4:
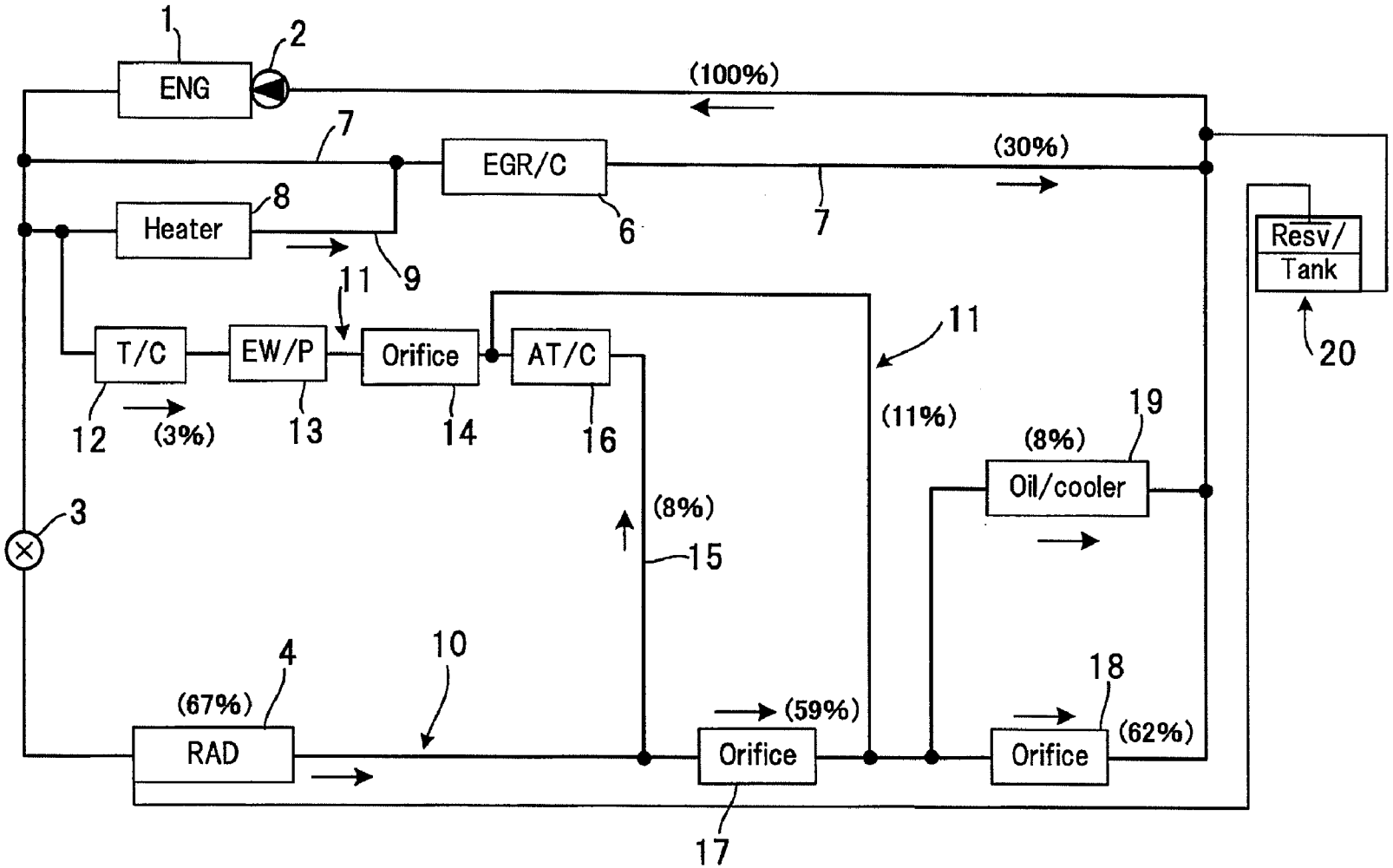
FIG. 4 is a block diagram of the internal combustion engine cooling system illustrated in FIGS. 2 and 3, but indicating the coolant flow after engine warming is complete.

The operation of an internal combustion engine cooling system in accordance with this embodiment will now be explained with reference to FIGS. 3 and 4.

When the engine is warming up and the coolant temperature is low, the thermostat valve 3 is closed such that coolant does not flow downstream of the thermostat valve 3. Consequently, as indicated with arrows in FIG. 3, the coolant pumped through the water jacket 1 by the water pump 2 bypasses the thermostat valve 3 and the radiator 4 and all (100%) of the coolant passes in a parallel fashion through the EGR cooler circulation passage 7, the heater passage 9 and the bypass passage 11. The number values (percentages) shown along the passages in FIG. 3 indicate the amount (percentage) of coolant that flows through each of the passages under certain operating conditions under the assumption that 100% is the total amount of coolant discharged from the water pump 2. These values are provided as a reference and are not intended to be exact percentages. The flow resistances of the passages can change depending on the operating state of the engine (e.g., the engine speed) and cause the percentage values to change.

The coolant passing through the heater passage 9 enters the heater core 8 and releases heat that is used to heat the cabin interior of the vehicle. The coolant existing the heater core 8 then mixes with the un-cooled coolant in the EGR cooler circulation passage 7 before entering and passing through the EGR cooler 6. The coolant entering the EGR cooler 6 is warmed as it passes through the heat exchanger section of the EGR cooler 6. Since the EGR valve 5B is closed during engine warming, the exhaust gas is not recirculated and the coolant does not release as much heat as it otherwise would before returning to the water pump 2.

Meanwhile, the coolant flowing into the bypass passage 11 passes through the turbo cooler 12, the electric water pump 13, and the orifice 14. Then a portion of the coolant branches into the bridge passage 15 and the remainder flows to the downstream portion of the bypass passage 11 and returns to the water pump 2 via the coolant circulation passage 10.

The coolant that branches into the bridge passage 15 passes through the oil heat exchanger (AT cooler) 16 and exchanges heat with the transmission oil that circulates through the transmission. The coolant exiting the oil heat exchanger (AT cooler) 16 flows to the coolant circulation passage 10 on the downstream side of the radiator 4 and passes through the orifice 17 before merging with the coolant flowing from the downstream end of the bypass passage 11 and returning to the water pump 2. The oil heat exchanger 16 serves to warm the transmission oil when the temperature of the transmission oil is lower than the coolant temperature and to warm the coolant and thus accelerate warming of the engine when the temperature of the transmission oil is higher than the coolant temperature. As a result, the automatic transmission can be prevented from reaching an excessive temperature and the warming of both the engine and the transmission can be accelerated after a cold start. Since warming of both the engine and the transmission after a cold start can be accelerated, friction in the engine and transmission can be reduced earlier when the engine is started under low-temperature conditions.

When, for example, a driver suddenly demands high-load operation of the engine by operating the accelerator while the engine is cold or not yet finished warming up, there is the possibility that the temperature of the transmission oil will suddenly rise. With this embodiment, however, the transmission oil can be cooled and an abrupt increase in the transmission oil temperature can be prevented because a portion of the coolant is circulated to the oil heat exchanger 16.

When the engine is cold started, there is a region where use of the EGR apparatus 5 is restricted because the coolant temperature is low. However, with this embodiment, the restriction on the use of the EGR apparatus 5 can be lifted earlier because the warming of the engine is accelerated by the oil heat exchanger 16. Thus, combustion using EGR gas introduced into the engine can be conducted comparatively early after the engine is started. As a result, the exhaust gas emissions can be reduced and the fuel efficiency can be improved.

The amount of coolant that branches into the bridge passage 15 can be adjusted by adjusting the opening surface area of the orifice 17 arranged downstream of the position where the bridge passage 15 branches from the coolant circulation passage 10. The opening surface area of the orifice 17 controls the flow resistance generated by the orifice 17. The amount of coolant passing through the bridge passage 15 decreases when the orifice 17 is constricted such that the flow resistance increases, and the amount of coolant passing through the bridge passage 15 increases when the orifice 17 is opened. While the engine is warming up, the rotational speed of the engine is generally comparatively low and, thus, the amount of coolant discharged from the water pump 2 is comparatively small. The amount of coolant passing through the bypass passage 11 and the passage flow resistance caused by the orifice 17 arranged in the coolant circulation passage 10 are also comparatively small. Consequently, the orifice 17 should be adjusted such that the amount of coolant flowing through the bridge passage 15 is approximately one half or slightly less than half of the amount of coolant flowing through the bypass passage 11.

Conversely, when the thermal load is high (e.g., when the outside temperature is high, the engine load is large, and/or the transmission load is large), the temperature of the coolant becomes high. Under such conditions, the thermostat valve 3 is fully open and the coolant pumped out of the water jacketed 1 by the water pump 2 flows as indicated with the arrows shown in FIG. 4. More specifically, the coolant flows back to the water pump 2 through the portion of the coolant circulation passage 10 containing the radiator 4, through the heater passage 9 and EGR cooler circulation passage 7, and through the bypass passage 11. The number values (percentages) shown along the passages in FIG. 4 indicate the amount (percentage) of coolant that flows through each of the passages under certain operating conditions under the assumption that 100% is the total amount of coolant discharged from the water pump 2. These values are provided as a reference and are not intended to be exact percentages. The flow resistances of the passages can change depending on the operating state of the engine (e.g., the engine speed) and cause the percentage values to change.

The coolant circulating through the heater passage 9 and the EGR cooler circulation passage 7 has a high temperature because it has come directly from the water jacket 1 of the engine. The coolant passing through the heated core 8 releases and becomes lower in temperature as it exchanges heat with the cabin air in the heater coil 8, thus serving to heat the interior of the cabin. The coolant exiting the heater core 8 then merges with higher-temperature coolant that has not passed through the heater core 8 in the EGR cooler circulation passage 7 and flows into the EGR cooler 6. After the engine has warmed up and the EGR valve 5B has been opened, a portion of the exhaust gas is circulated to the air induction system through the EGR passage 5A and the EGR cooler 6. The coolant passing through the EGR cooler 6 cools the exhaust gas passing through the EGR cooler 6 by absorbing heat from the exhaust gas and returns to the water pump 2 at a higher temperature than it had prior to passing through the EGR cooler 6.

The coolant flowing to the bypass passage 11 passes through the turbo cooler 12, the electric water pump 13, and the orifice 14 and returns directly to the water pump 2 after merging with the coolant circulation passage 10.

The coolant in the coolant circulation passage 10 flows through the fully opened thermostat valve 3 and the radiator 4. Most of the coolant cooled in the radiator 4 passes through the orifice 17 and returns to the water pump 2. Meanwhile, a portion of the coolant exiting the radiator 4 flows into the bridge passage 15 due to the flow passage resistance set by the orifice 17. The flow of coolant into the bridge passage 15 in such a case is oriented in the opposite direction as when the thermostat valve 3 is closed. The coolant flowing through the bridge passage 15 in this case passes through the oil heat exchanger (AT cooler) 16 and enters the bypass passage 11 through the portion where the bridge passage 15 merges with the bypass passage 11 downstream of the orifice 14. The coolant that has passed through the upstream portion of the bypass passage 11 merges with the coolant from the bridge passage 15 downstream of the orifice 17. The merged coolant flows through the portion of the bypass passage 11 located downstream of the orifice 17, merges with coolant that has passed through the orifice 17 at the portion where the bypass passage 11 connects to the coolant circulation passage 10, and returns to the water pump 2.

In this case, the amount of coolant that branches to the bridge passage 15 can adjusted by adjusting the opening surface area of the orifice 17 arranged in the coolant circulation passage 10 downstream of the position where the bridge passage 15 branches from the coolant circulation passage 10. The opening surface area of the orifice 17 controls the flow resistance generated by the orifice 17.

In this state, coolant flows in both the bypass passage 11 and the portion of the coolant circulation passage 10 downstream of the radiator 4, and the orifice 17 provided downstream of the radiator 4 causes a portion of the coolant to flow through the bridge passage 15 to the oil heat exchanger 16. In short, coolant that has just passed through the radiator 4 and coolant that has not passed through any heat exchanging section that would increase its temperature can be directed to the oil heat exchanger 16. In short, the coolant that has the lowest temperature of any coolant in the system can be sent to the oil heat exchanger 16. Consequently, coolant can be sent directly to the oil heat exchanger 16 for the purpose of cooling the automatic transmission oil so that the transmission oil can be cooled more efficiently and the transmission oil temperature can be suppressed with a smaller oil heat exchanger 16 even under high load, high coolant temperature conditions.

The effects that can be obtained with this embodiment will now be explained.

An internal combustion engine cooling system in accordance with this embodiment has the coolant circulation passage 10 configured and arranged to pass a coolant (cooling medium) exiting the water jacket 1 of the internal combustion engine through the radiator 4 and return the coolant to the water jacket 1. The thermostat valve 3 is arranged between an inlet of the radiator 4 and an outlet of the water jacket 1, with the bypass passage 11 being configured and arranged to branch from the coolant circulation passage at a position located between the outlet of the water jacket 1 and the thermostat valve 3. The bypass passage 11 connects to the coolant circulation passage on an outlet side of the radiator 4 so as to bypass the thermostat valve 3 and the radiator 4. The cooling system apparatus further has the bridge passage 15 configured and arranged to connect an intermediate portion of the bypass passage 11 to a portion of the coolant circulation passage 10 located downstream of the radiator 4, thus establishing communication between intermediate portions of the bypass passage 11 and the coolant circulation passage 10. The passage resistance generating section, e.g., an orifice 17, is arranged in a portion of the coolant circulation passage 10 located downstream of a position where the bridge passage 15 connects to the coolant circulation passage 10 and upstream of the position where the bypass passage 11 merges with the coolant circulation passage 10. The oil heat exchanger 16 is arranged in the bridge passage 15 to exchange heat between the coolant and a transmission oil passing therethrough.

As a result, during engine warming, the warming of the engine can be accelerated by closing the thermostat valve 3 and returning the coolant exiting the water jacket 1 back to the water jacket 1 through the bypass passage 11. While the thermostat valve 3 is closed, the orifice 17 (which is arranged in the coolant circulation passage 10 downstream of the oil heat exchanger 16) is set to generate such a flow passage resistance that a portion of the coolant flowing through the bypass passage 11 branches into the bridge passage 15 with a portion of the coolant flowing through the bypass passage 11 exchanging heat in the oil heat exchanger 16 before returning to the engine. Thus, while most of the coolant returns directly to the engine, an appropriate amount can be used to exchange heat in the oil heat exchanger 16. As a result, the coolant can be directed to the oil heat exchanger 16 even when the thermostat valve 3 is closed, thus enabling the oil temperature to be prevented from rising excessively when the engine operates under a very high load while cold.

Additionally, after a cold start, the warming of both the engine and the transmission can be accelerated while preventing the automatic transmission from reaching an excessive temperature. Since warming of both the engine and the transmission after a cold start can be accelerated, friction in the engine and transmission can be reduced earlier when the engine is started under low-temperature conditions. Furthermore, since warming of the engine can be accelerated, combustion using recirculated exhaust gas can be conducted earlier and the exhaust emissions can be improved earlier.

Additionally, after the engine is warm and the thermostat valve 3 is opened, the coolant exiting the engine flows to the radiator 4 and a portion of the coolant cooled in the radiator 4 branches from the upstream side of the orifice 17 (e.g., a passage resistance generating section) and flows into the bridge passage 15 in the opposite direction as when the engine is warming, thus flowing directly to the oil heat exchanger 16 for the purpose of cooling the automatic transmission oil. As a result, when the thermostat valve 3 is opened, coolant flowing downstream of the radiator 4, which is the coolest coolant in the system, can be directed to the oil heat exchanger 16, thus enabling the oil temperature to be prevented from rising excessively when the engine operates under a very high load and enabling the size of the oil heat exchanger 16 to be reduced.

Since coolant can be passed through the oil heat exchanger 16 in one direction or the opposite direction by opening and closing the thermostat valve 3, this embodiment can be realized without adding additional valves or making the coolant passages more complex. As a result, the effect described above can be achieved at a low cost.

The bypass passage 11 is preferably provided with the turbo cooler 12, the electric water pump 13, and the orifice 14 that serve to restrict the bypass passage 11 or increase the flow resistance of the bypass passage 11 at a position upstream of where the bridge passage 15 connects to the bypass passage 11. As a result, coolant flowing through the bridge passage 15 after the engine is warm and the thermostat valve 3 is opened can be prevented from back flowing upstream into the bypass passage 11 and can be made to merge and flow downstream with the coolant flowing through the bypass passage 11.

Since the cooling system cools the turbo cooler 12 and the electric water pump 13, which are auxiliary machines provided on the engine and serve to restrict or increase the flow resistance of the bypass passage 11, the heat absorbed by cooling the auxiliary machines during engine warming serves to accelerate the warming of the engine.

The EGR cooler 6 is provided in the EGR passage 5A that is arranged with one end connected to the exhaust system of the engine and the other end connected to the air induction system of the engine. Coolant flows through the EGR cooler 6 and exchanges heat with the exhaust gas flowing through the EGR passage 5A, thereby cooling the recirculated exhaust gas. The EGR cooler 6 is provided in the EGR cooler circulation passage 7 that is arranged in parallel with the bypass passage 11 such that coolant flowing therethrough from the water jacket 1 bypasses the thermostat valve 3 and the radiator 4 and returns to the water jacket 1. As a result, when the engine is warming up and the EGR valve 5B is closed such that exhaust gas is not recirculated, the coolant passing through the EGR cooler circulation passage 7 does not release as much heat before returning to the water pump 2 as it would if the EGR valve 5B was open and, thus, the engine warming is accelerated.

The cooling system is configured such that a portion of the coolant exiting the water jacket 1 passes through the heater passage 9, exchanges heat with air in the heater core 8, and is introduced into the EGR cooler circulation passage 7 upstream of the EGR cooler 6. As a result, coolant that has released heat in the heater core 8 in order to heat the vehicle interior is added to the coolant passing through the EGR cooler 6. The introduction of lower-temperature coolant enables the EGR cooler 6 to cool the recirculated exhaust gas more efficiently.

The bypass passage 11 connects to the coolant circulation passage 10 at a position downstream of the orifice 17 (e.g., a passage resistance generating section) and a branch passage leading to an oil cooler 19 is arranged downstream of where the bypass passage 11 connects to the coolant circulation passage 10. As a result, the temperature of the engine oil can be adjusted regardless of whether the engine is warming up or has already warmed up.

GENERAL INTERPRETATION OF TERMS

In understanding the scope of the present invention, the term "comprising" and its derivatives, as used herein, are intended to be open ended terms that specify the presence of the stated features, elements, components, groups, integers, and/or steps, but do not exclude the presence of other unstated features, elements, components, groups, integers and/or steps. The foregoing also applies to words having similar meanings such as the terms, "including", "having" and their derivatives. Also, the terms "part," "section," "portion," "member" or "element" when used in the singular can have the dual meaning of a single part or a plurality of parts. Also as used herein to describe the above embodiment(s), the following directional terms "forward", "rearward", "above", "downward", "vertical", "horizontal", "below" and "transverse" as well as any other similar directional terms refer to those directions of a vehicle equipped with the present invention. Accordingly, these terms, as utilized to describe the present invention should be interpreted relative to a vehicle equipped with the present invention. The terms of degree such as "substantially", "about" and "approximately" as used herein mean a reasonable amount of deviation of the modified term such that the end result is not significantly changed.

While only selected embodiments have been chosen to illustrate the present invention, it will be apparent to those skilled in the art from this disclosure that various changes and modifications can be made herein without departing from the scope of the invention as defined in the appended claims. For example, the size, shape, location or orientation of the various components can be changed as needed and/or desired. Components that are shown directly connected or contacting each other can have intermediate structures disposed between them. The functions of one element can be performed by two, and vice versa. The structures and functions of one embodiment can be adopted in another embodiment. It is not necessary for all advantages to be present in a particular embodiment at the same time. Every feature which is unique from the prior art, alone or in combination with other features, also should be considered a separate description of further inventions by the applicant, including the structural and/or functional concepts embodied by such feature(s). Thus, the foregoing descriptions of the embodiments according to the present invention are provided for illustration only, and not for the purpose of limiting the invention as defined by the appended claims and their equivalents.

What is claimed is:

1. An internal combustion engine cooling system comprising:

an engine water jacket of an internal combustion engine;

a coolant circulation passage fluidly connecting a water jacket outlet of the engine water jacket to a water jacket inlet of the engine water jacket;

a radiator disposed in the coolant circulation passage between the water jacket outlet and the water jacket inlet;

a thermostat valve disposed in the coolant circulation passage between an inlet side of the radiator and the water jacket outlet to close the coolant circulation passage leading to the radiator when a coolant temperature of a cooling medium is lower than a prescribed temperature and to open the coolant circulation passage leading to the radiator when the coolant temperature of the cooling medium is equal to or higher than a prescribed temperature;

a bypass passage branching from the coolant circulation passage at a position located between the water jacket outlet and the thermostat valve and connecting to the coolant circulation passage on an outlet side of the radiator for bypassing the thermostat valve and the radiator;

a bridge passage connecting an intermediate portion of the bypass passage to an intermediate portion of the coolant circulation passage located downstream of the radiator and upstream of a merging position where the bypass passage merges with the coolant circulation passage for establishing communication between the intermediate portions of the bypass passage and the coolant circulation passage;

a circulation passage resistance generating section arranged in a portion of the coolant circulation passage located downstream of a position where the bridge passage connects to the coolant circulation passage and upstream of the merging position where the bypass passage merges with the coolant circulation passage; and an oil heat exchanger arranged in the bridge passage to exchange heat between the cooling medium and transmission oil passing therethrough.

2. The internal combustion engine cooling system as recited in claim 1, wherein the bypass passage is provided with at least one bypass passage resistance generating section upstream of a position where the bridge passage connects to the bypass passage.

3. The internal combustion engine cooling system as recited in claim 2, wherein the bypass passage resistance generating section is a cooling device provided on the internal combustion engine.

4. The internal combustion engine cooling system as recited in claim 1, further comprising an exhaust gas recirculation cooling device having one end connected to an exhaust system of the internal combustion engine and another end connected to an air induction system of the internal combustion engine to cool exhaust gas flowing through an exhaust gas recirculation passage by exchanging heat between the cooling medium and the exhaust gas flowing through the exhaust gas recirculation passage, the exhaust gas recirculation cooling device being disposed in an exhaust gas recirculation cooling device recirculation passage that is connected in parallel with the bypass passage and arranged to return the cooling medium exiting the water jacket to the water jacket while bypassing radiator and the thermostat valve.

5. The internal combustion engine cooling system as recited in claim 4, further comprising a cabin heater core contained in a heater passage branching from the coolant circulation passage at a position located between the water jacket outlet and the thermostat valve and connecting to the exhaust gas recirculation cooling device recirculation passage to introduce the cooling medium that has passed through the cabin heater core to an upstream side of the exhaust gas recirculation cooling device.

6. An internal combustion engine cooling method comprising:

circulating a cooling medium from a water jacket outlet of an engine water jacket of an internal combustion engine to a water jacket inlet of the engine water jacket;

passing the cooling medium through a radiator disposed in the coolant circulation passage between the water jacket outlet and the water jacket inlet when a coolant temperature of the cooling medium is equal to or higher than a prescribed temperature;

passing the cooling medium through a bypass passage to bypass the radiator when the coolant temperature of the cooling medium is lower than a prescribed temperature and to open the coolant circulation passage leading to the radiator;

passing the cooling medium through a bridge passage connecting an intermediate portion of the bypass passage to an intermediate portion of the coolant circulation passage located downstream of the radiator and upstream of a merging position where the bypass passage merges with the coolant circulation passage for establishing communication between the intermediate portions of the bypass passage and the coolant circulation passage;

restricting flow of the cooling medium through a portion of the coolant circulation passage located downstream of a position where the bridge passage connects to the coolant circulation passage and upstream of the merging position where the bypass passage merges with the coolant circulation passage; and exchanging heat between the cooling medium and transmission oil passing through an oil heat exchanger arranged in the bridge passage.

7. The internal combustion engine cooling method as recited in claim 6, wherein restricting flow of the cooling medium through a portion of the bypass passage upstream of a position where the bridge passage connects to the bypass passage.

8. The internal combustion engine cooling method as recited in claim 7, wherein the restricting flow of the cooling medium through the portion of the bypass passage bypass is performed by using a cooling device provided on the internal combustion engine.

9. The internal combustion engine cooling method as recited in claim 6, further comprising passing the cooling medium through an exhaust gas recirculation cooling device contained in an exhaust gas recirculation cooling device recirculation passage that is connected in parallel with the bypass passage and arranged to return the cooling medium exiting the water jacket to the water jacket while bypassing radiator, such that the cooling medium passing through the exhaust gas recirculation cooling device exchanging heat with exhaust gas flowing through the exhaust gas recirculation cooling device, which has one end connected to an exhaust system of the internal combustion engine and another end connected to an air induction system of the internal combustion engine.

10. The internal combustion engine cooling method as recited in claim 9, further comprising passing the cooling medium through a cabin heater core contained in a heater passage branching from the coolant circulation passage at a position located upstream of the radiator and connecting to the exhaust gas recirculation cooling device recirculation passage to introduce the cooling medium that has passed through the heater passage to an upstream side of the exhaust gas recirculation cooling device, such that the cooling medium exiting the water jacket exchanges heat with air passing through the cabin heater core.

* * * * *